US010082353B1

(12) United States Patent
Chaing

(10) Patent No.: US 10,082,353 B1
(45) Date of Patent: Sep. 25, 2018

(54) DRUM MAGAZINE

(71) Applicant: Pro Mag Mfg., Inc., Phoenix, AZ (US)

(72) Inventor: Chrisman L. Chaing, Phoenix, AZ (US)

(73) Assignee: PRO MAG MFG., INC., Phoenix, AZ (US)

( * ) Notice: Subject to any disclaimer, the term of this patent is extended or adjusted under 35 U.S.C. 154(b) by 0 days.

(21) Appl. No.: 15/728,237

(22) Filed: Oct. 9, 2017

(51) Int. Cl.
*F41A 9/73* (2006.01)
*F41A 9/26* (2006.01)

(52) U.S. Cl.
CPC . *F41A 9/73* (2013.01); *F41A 9/26* (2013.01)

(58) Field of Classification Search
CPC ..... F41A 9/26; F41A 9/27; F41A 9/28; F41A 9/73; F41A 9/74; F41A 9/75; F41A 9/03
USPC ..... 89/33.02
See application file for complete search history.

(56) References Cited

U.S. PATENT DOCUMENTS 1,921,871 A * 8/1933 Gaidos ..... F41A 9/73 42/50
2,338,984 A * 1/1944 Van Horn ..... F41A 9/73 42/50
4,811,510 A * 3/1989 Chesnut ..... F41A 9/70 42/50
8,220,377 B2 * 7/2012 Quetschke ..... F41A 9/75 42/49.01

FOREIGN PATENT DOCUMENTS

WO WO 87/00614 * 1/1987

* cited by examiner

*Primary Examiner* — Stephen Johnson
(74) *Attorney, Agent, or Firm* — Bennet K. Langlotz; Langlotz Patent & Trademark Works, Inc.

(57) ABSTRACT

Drum magazines have a housing defining an ammunition passage having an outlet, a first spring mechanism adapted to bias ammunition in the passage toward the outlet, and a follower element in the passage, the follower element including a second spring mechanism adapted to generate a biasing force against a passage surface portion, such that the follower resists movement within the passage in the absence of a deliberately applied force. The magazine may be a drum magazine, and the passage may have a spiral shape. The first spring mechanism may include a control adapted to selectably change the first spring mechanism from a biasing condition in which force is applied to the follower element for motivating ammunition toward the outlet, and a loading condition in which the first spring mechanism is restrained to facilitate loading of the magazine in the absence of a biasing force.

20 Claims, 4 Drawing Sheets

DRUM MAGAZINE

FIELD OF THE INVENTION

The present invention relates to firearms, and more particularly to a drum magazine for rimmed ammunition.

BACKGROUND OF THE INVENTION

A drum magazine is a type of firearms magazine that is often cylindrical in shape, like a drum.

Instead of rounds being stored flat, as in a more common box magazine, rounds in a drum magazine are stored in a circle around the center of the magazine, facing the direction of the barrel. Drum magazines for rimless ammunition are typically driven by a single hub and a telescopic shaft.

The advantage over traditional box-shaped magazines is that a drum magazine can carry much more ammunition, often two to three times that of a box magazine, without making it too big to be impractical to carry. The downside to drum magazines is they increase the overall weight of the weapon in which they are being used, and they are more prone to jamming because of their more complex internal geometry. When the mainspring is unwound so the operator is not having to overcome a strong biasing force when loading new cartridges, sometimes the telescopic shaft is moved out of contact with the stack of cartridges. The absence of pressure on the stack of cartridges can enable one or more cartridges to become misaligned within the interior of the drum magazine. As a result, the magazine can become jammed and unable to feed cartridges to an attached firearm once the mainspring is wound and the telescopic shaft exerts pressure upon the stack of cartridges.

Therefore, a need exists for a new and improved drum magazine that supports the stack of cartridges during loading even when the telescopic shaft does not contact the stack of cartridges. In this regard, the various embodiments of the present invention substantially fulfill at least some of these needs. In this respect, the drum magazine according to the present invention substantially departs from the conventional concepts and designs of the prior art, and in doing so provides an apparatus primarily developed for the purpose of providing the additional capacity of a drum magazine while preventing the ammunition from jamming during the loading of new cartridges.

SUMMARY OF THE INVENTION

The present invention provides an improved drum magazine, and overcomes the above-mentioned disadvantages and drawbacks of the prior art. As such, the general purpose of the present invention, which will be described subsequently in greater detail, is to provide an improved drum magazine that has all the advantages of the prior art mentioned above.

To attain this, the preferred embodiment of the present invention essentially comprises a housing defining an ammunition passage having an outlet, a first spring mechanism adapted to bias ammunition in the passage toward the outlet, and a follower element in the passage, the follower element including a second spring mechanism adapted to generate a biasing force against a passage surface portion, such that the follower resists movement within the passage in the absence of a deliberately applied force. The magazine may be a drum magazine, and the passage may have a spiral shape. The first spring mechanism may include a control adapted to selectably change the first spring mechanism from a biasing condition in which force is applied to the follower element for motivating ammunition toward the outlet, and a loading condition in which the first spring mechanism is restrained to facilitate loading of the magazine in the absence of a biasing force. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
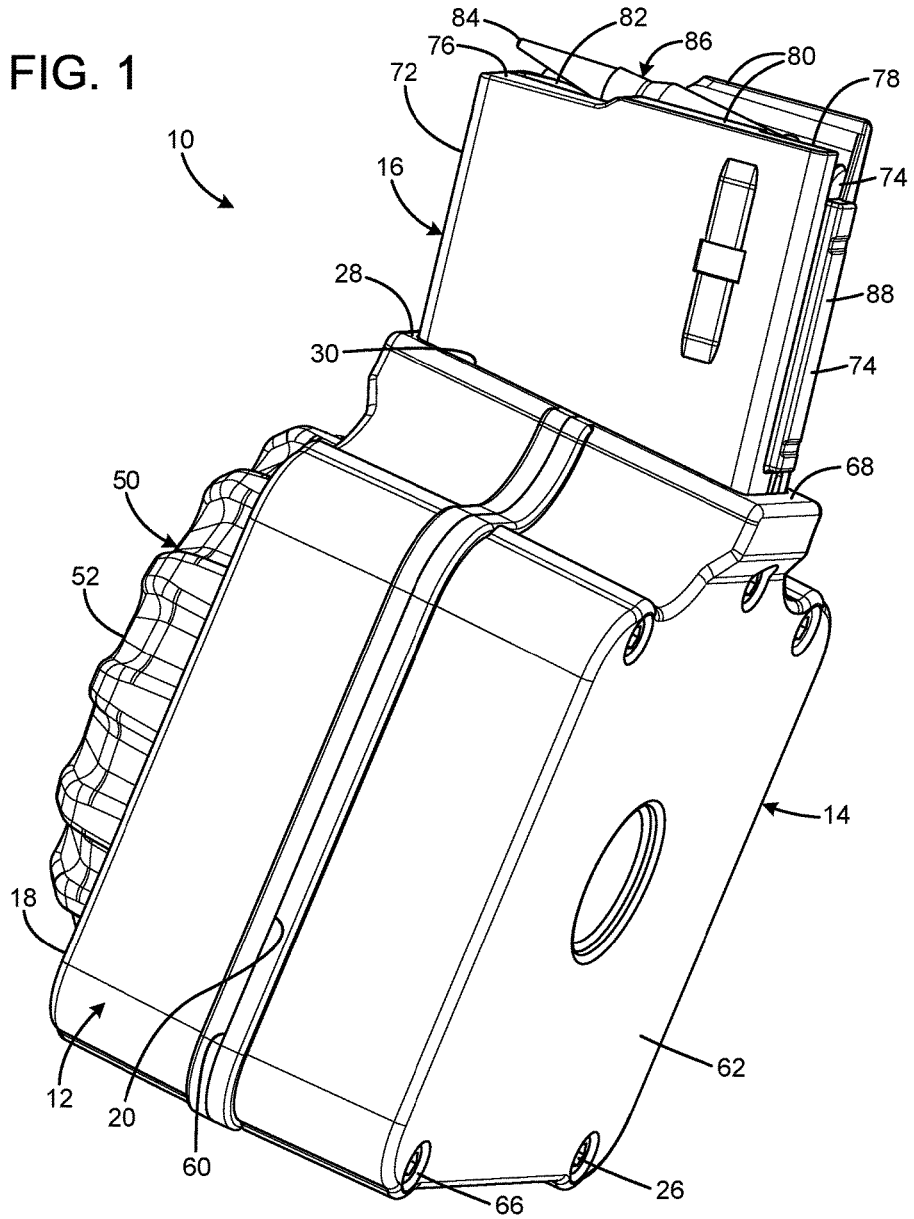
FIG. 1 is a top isometric view of the current embodiment of the drum magazine constructed in accordance with the principles of the present invention.

An embodiment of the drum magazine of the present invention is shown and generally designated by the reference numeral 10.

Figure 2:
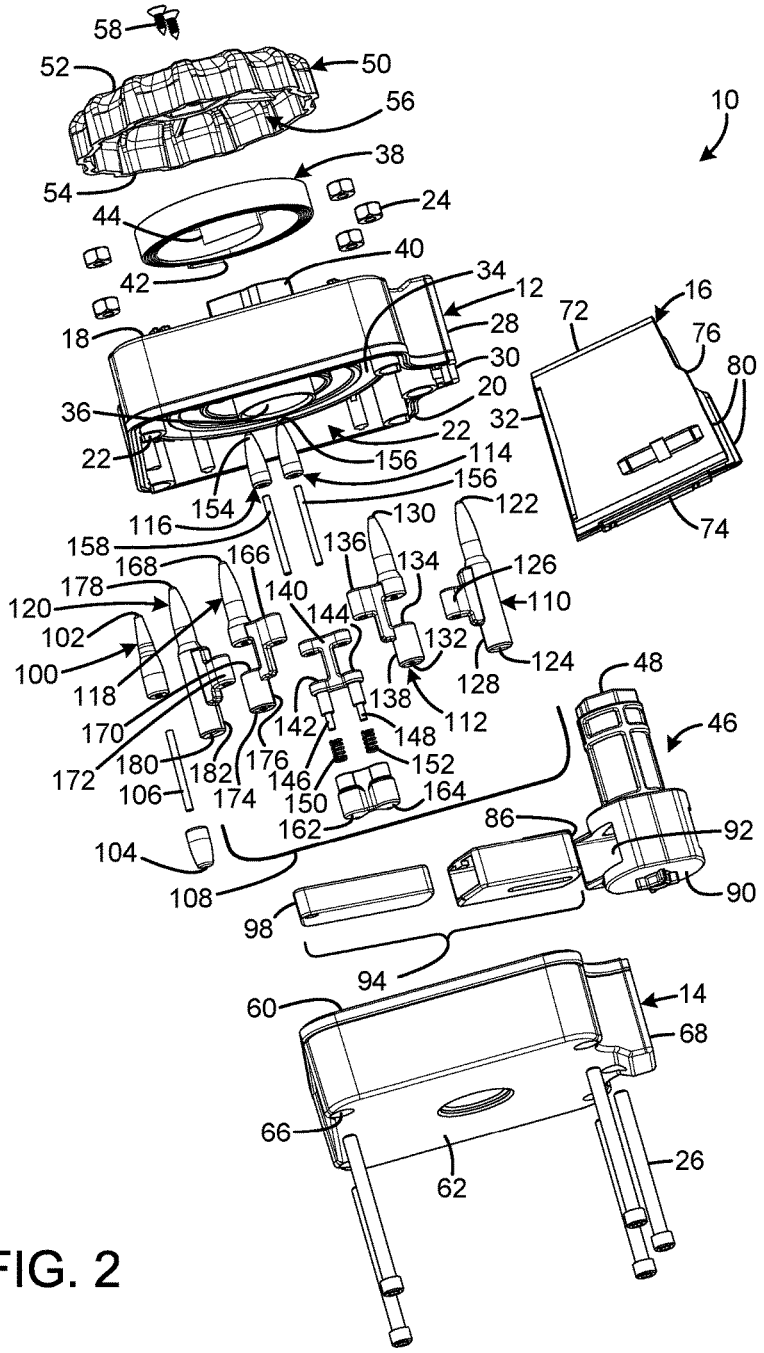
FIG. 2 is an exploded view of the drum magazine of FIG. 1.

FIGS. 1 and 2 illustrate the improved drum magazine 10 of the present invention. More particularly, the drum magazine 10 has a front housing 12 with a removably attached rear housing 14 and an upwardly extending tower 16.

The front housing 12 is a hollow generally square body having a front 18, rear 20, and an interior 22. The front housing defines five apertures 22, each of which receives a nut 24 that is threadedly attached to the threaded portion of a bolt 26. The top 28 of the front housing defines the front portion of an opening 30 that receives the bottom 32 of the tower 16. In the current embodiment, the front housing is made of black plastic. The interior of the front housing defines a spiral/arcuate front passage 34 and a central aperture 36. The front of the front housing receives a mainspring 38. A winding knob 40 protruding from the front of the front housing is attached to the winding knob end 42 of the mainspring. The mainspring has an opposed rotor end 44 that is attached to the front 48 of a rotor 46. A winding knob cover 50 has a front 52, rear 54, and interior 56 that covers the mainspring and is secured to the winding knob by two screws 58. The winding knob is turned clockwise (when viewed from the front) to wind up the mainspring and is turned counterclockwise (when viewed from the front) to unwind the mainspring. The winding knob can be held in the wound-up position by a locking mechanism (not shown).

Figure 3:
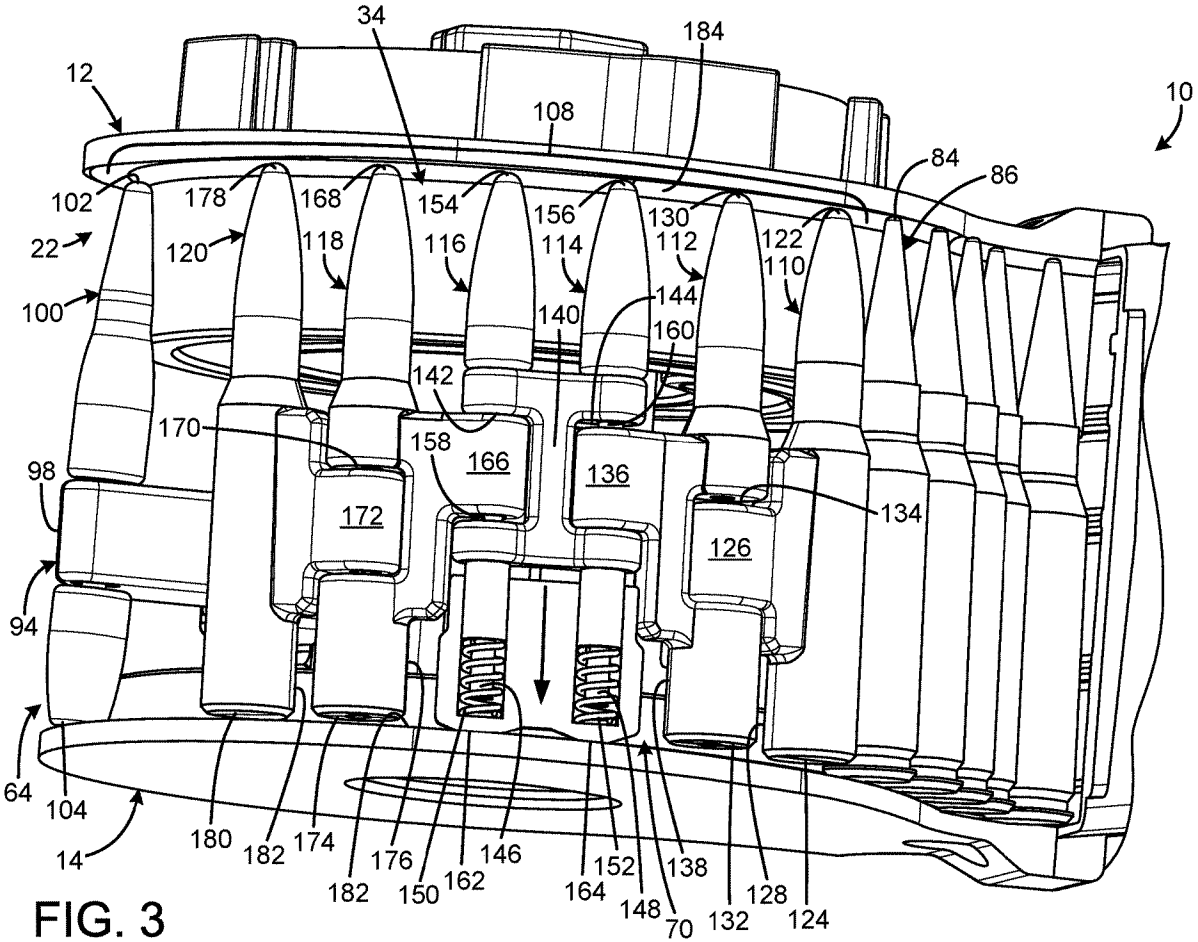
FIG. 3 is an enlarged side sectional view of the drum magazine of FIG. 1.

The rear housing 14 has a front 60, rear 62, and an interior 64 (shown in FIG. 3). The rear defines five apertures 66 that receives the head portions of the bolts 26. The rear housing removably closes the rear 20 of the front housing 12 with the front of the rear housing abutting the rear of the front housing. The top 68 of the rear housing defines the rear portion of the opening 30 that receives the bottom 32 of the tower 16. In the current embodiment, the rear housing is made of black plastic. The interior of the rear housing defines a spiral/arcuate rear passage 70.

The tower 22 has a front 72, a rear 74, a top 76, and a hollow interior (not visible). The hollow interior and the spiral front and rear passages 34, 70 define an ammunition passage. The top of the tower has an outlet/opening 78 that communicates with the hollow interior of the tower, which in turn communicates with the hollow interiors 22, 64 of the front and rear housings 12, 14. The opening is partially defined by feed lips 80 located at the top rear of the tower. The top of the tower defines a ramp 82 in front of the feed lips. The feed lips and ramp serve to guide the nose 84 of live rimless cartridges 86 forward and upward as the cartridges are fed into a firearm (not shown) attached to the tower. The rear of the tower includes a ledge 88 that engages a magazine well latch in the firearm to releasably secure the drum magazine 10 to the firearm. In the current embodiment, the tower is made of black plastic. In the current embodiment, the cartridges 38 are 0.308 rimless cartridges, and the hollow interior of the tower has a capacity of six cartridges denoted by the stack of six cartridges 186 shown in FIG. 4.

The rotor 46 has an elongated front portion 48 and a wider, shorter rear portion 90. The front portion is received within the aperture 36 in the front housing 12, and the rotor is free to rotate within the front and rear housings 12, 14 under the influence of the mainspring 38. The rear portion defines a slot 92 that receives one end 96 of a telescoping arm 94. The opposed free end 98 of the telescoping arm has an attached rotor arm dummy cartridge 100. The rotor arm dummy cartridge has a nose 102 and rear 104 that are connected to each other and the free end of the telescoping arm by a pin 106. The telescoping arm telescopes so the nose of the rotor arm dummy cartridge can travel freely within the spiral front passage 34 of the front housing, and the rear of the rotor arm dummy cartridge can travel freely within the spiral rear passage 70 of the rear housing when the wound mainspring urges the rotor to rotate to feed live rimless cartridges 86 through the opening 78 in the tower 22. The mainspring is a first spring mechanism adapted to bias ammunition in the ammunition passage toward the outlet 78.

The rotor arm dummy cartridge 100 urges live rimless cartridges 86 around the spiral front and rear passages 34, 70 by acting upon an intermediate element: follower 108. The follower is an assemblage/plurality of interconnected elements of dummy cartridges 110, 112, 114, 116, 118, 120. Dummy cartridge 110 has a nose 122, rear 124, and an outwardly protruding link 126 on the left side 128. Dummy cartridge 112 has a nose 130, rear 132, a central slot 134 receiving link 126, and an outwardly protruding link 136 on the left side 138. Dummy cartridges 114 and 116 are joined together by a body 140 having left and right slots 142, 144, rearward-facing posts 146, 148, springs 150, 152, noses 154, 156, pins 158, 160, and rears 162, 164. The pins connect the noses to the rears and secure links 136 within slot 144 and link 166 within slot 142. Dummy cartridge 118 has a nose 168, central slot 170 that receives link 172, rear 174, and link 166, which protrudes outwardly on the right side 176. Dummy cartridge 120 has a nose 178, rear 180, and link 172, which protrudes outwardly on the right side 182. The noses of the dummy cartridges 110, 112, 114, 116, 118, 120 are received by the spiral front passage 34 of the front housing 12. The rears of the dummy cartridges 110, 112, 114, 116, 118, 120 are received by the spiral rear passage 70 of the rear housing 14. Springs 150,152 are a second spring mechanism adapted to generate a biasing force against a passage surface portion, such that the follower resists movement within the ammunition passage in the absence of a deliberately applied force.

FIG. 3 illustrates the improved drum magazine 10 of the present invention. More particularly, the drum magazine is shown in section so the interiors 22, 70 of the front and rear housings 12, 14 are visible. The drum magazine is shown with the mainspring 38 in the wound condition urging the rotor 46 to rotate, the combination of which serves as a drive mechanism that transmits an ammunition biasing force and urges the rotor arm dummy cartridge 100 against the dummy cartridge 120 of the follower 108. The springs 150, 152 urge the rears 162, 164 of dummy cartridges 116, 114 of the follower against the rear passage wall 182 of the spiral rear passage 70 and the noses 154, 156 of the dummy cartridges 116, 114 against the front passage wall 184 of the spiral front passage 34. Thus, the dummy cartridges 116, 114 serve as a friction facility. Each is an elongated element having a first end (noses) and an opposed second end (rears), and the second spring mechanism (springs 150, 152) is interconnected between the first end and the second end to bias the first end away from the second end. The dummy cartridges 116, 114 can also be considered to have a compressible length and a first portion and a second portion telescopically movable with respect to each other where the second spring mechanism biases the first portion and the second portion away from each other. In the current embodiment, the rear and front passage walls are rear and front interior surfaces that are opposed and parallel to each other, and the springs 150, 152 are made of metal.

Figure 4:
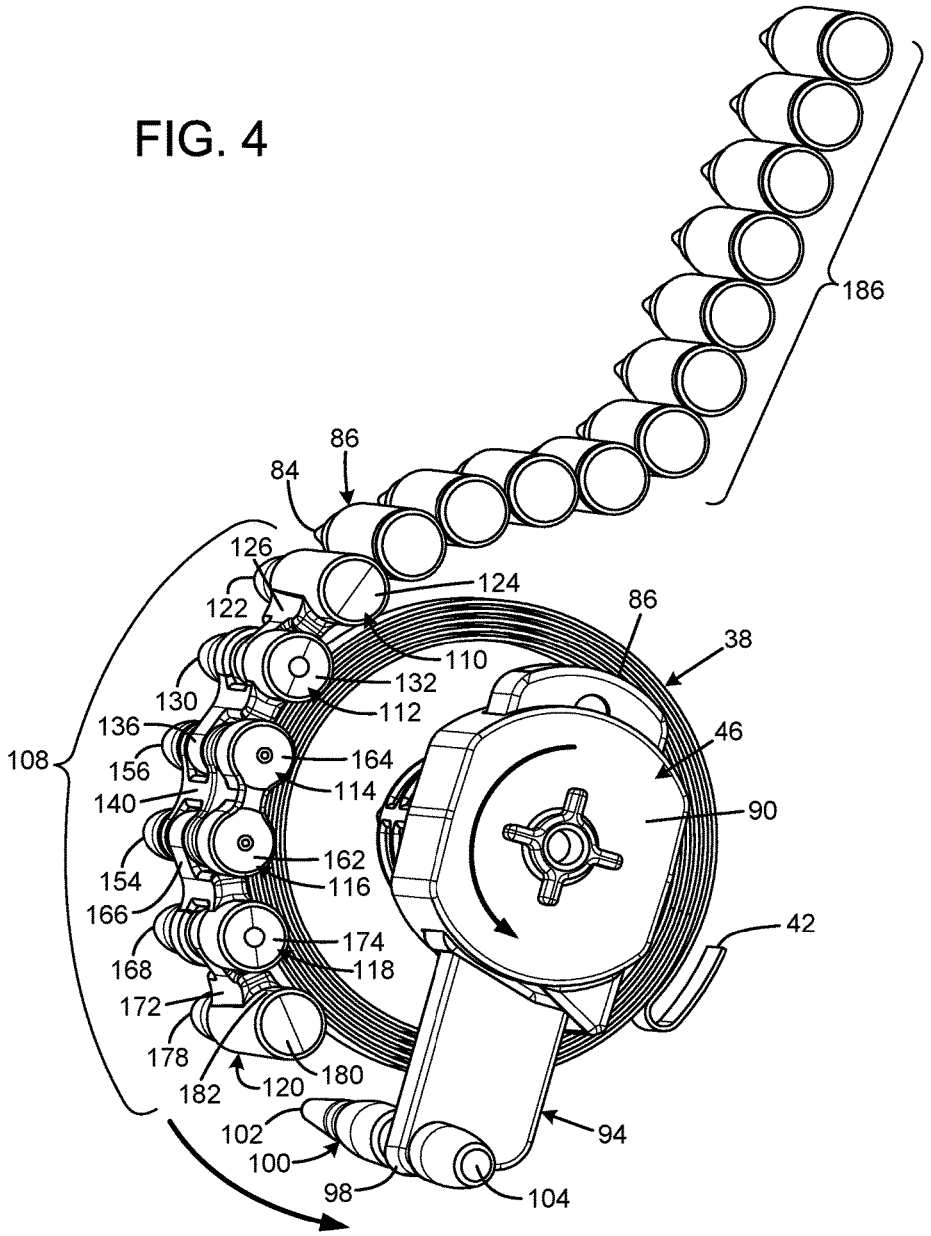
FIG. 4 is a rear isometric view of the drum magazine of FIG. 1 with the front and rear housing and the tower removed.

FIG. 4 illustrates the improved drum magazine 10 of the present invention. More particularly, the drum magazine is shown with the front and rear housings 12, 14 and tower 22 removed for clarity. The mainspring has been placed in the unwound condition so new cartridges can be loaded via the opening 78 in the top 76 of the tower 16. The first spring mechanism/mainspring includes a control adapted to selectably change the first spring mechanism from a biasing condition in which force is applied to the follower 108 for motivating ammunition 86 toward the opening 78, and a loading condition in which the first spring mechanism is restrained to facilitate loading of the magazine in the absence of a biasing force. Even though the rotor has been rotated so the rotor arm dummy cartridge 100 does not contact the follower 108, the contact between the dummy cartridges 110, 112, 114, 116, 118, 120 and the rear and front passage walls 182, 184 creates friction that resists movement of the follower within the spiral front and rear passages 34, 70. Thus, application of gentle pressure is required to move the follower as each cartridge is loaded, and the follower supports the stack of cartridges to prevent any cartridges from becoming misaligned. As a result, the drum magazine will not jam when the mainspring is wound and the rotor arm dummy cartridge urges the follower against the stack of cartridges.

The expansive, spring-loaded axial force generated by the follower 108 within the spiral front and rear passages 34, 70 creates limited, controllable friction that does not change as more or fewer live cartridges 86 are present within the drum magazine 10 and tower 16. Sufficient pressure is required to move the follower that the follower does not move under its own weight or the weight of up to a full load of live cartridges. However, the wound mainspring urges the rotor arm dummy cartridge 100 against the follower with sufficient force to move the follower and up to a full load of live cartridges within the spiral front and rear passages.

In the context of the specification, the terms "rear" and "rearward," and "front" and "forward" have the following definitions: "rear" or "rearward" means in the direction away from the muzzle of the firearm, while "front" or "forward" means it is in the direction towards the muzzle of the firearm.

While a current embodiment of a drum magazine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, a follower that is an assemblage of six dummy cartridges is disclosed because the hollow interior of the tower described has a capacity of six cartridges. Since the rotor arm dummy cartridge cannot travel up the tower, the flexibly-linked dummy cartridges of the follower can completely fill the tower and feed the last live cartridge in the stack of cartridges through the opening in the top of the tower. However, the quantity of dummy cartridges in the follower can vary depending upon the cartridge capacity of the interior of the tower.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine for a firearm comprising:

a housing defining an ammunition passage having an outlet;

the housing having front and rear walls having opposed interior surfaces;

a first spring mechanism adapted to bias ammunition in the ammunition passage toward the outlet;

a follower element in the ammunition passage; and the follower element including a second spring mechanism adapted to generate a biasing force against the interior surfaces of the front and rear walls, such that the follower creates friction to support cartridges during loading in the absence of a biasing force from the first spring mechanism.

2. The magazine of claim 1 wherein the magazine is a drum magazine, and the passage has a spiral shape.

3. The magazine of claim 1 wherein the first spring mechanism includes a control adapted to selectably change the first spring mechanism from a biasing condition in which force is applied to the follower element for motivating ammunition toward the outlet, and a loading condition in which the first spring mechanism is restrained to facilitate loading of the magazine in an absence of a biasing force.

4. The magazine of claim 1 wherein the follower element has a first portion adapted to contact the first spring mechanism and a second portion adapted to contact a round of ammunition in the passage.

5. The magazine of claim 1 wherein the follower element has a form of a plurality of interconnected elements each having a form of an ammunition cartridge.

6. The magazine of claim 1 wherein the follower element includes an elongated element having a first end and an opposed second end, and wherein the second spring mechanism is interconnected between the first end and the second end to bias the first end away from the second end.

7. The magazine of claim 6 wherein the elongated element has a form of an ammunition cartridge.

8. The magazine of claim 6 including a plurality of additional elongated elements connected to the elongated element.

9. The magazine of claim 1 wherein the follower element is adapted to generate an expansive force within the passage.

10. A drum magazine comprising:

a housing defining an arcuate ammunition storage passage having an outlet;

the housing having front and rear walls;

a drive mechanism adapted to generate an ammunition biasing force toward the outlet;

a follower having an elongated flexible body adapted to receive contact by the drive mechanism and to transmit the ammunition biasing force to ammunition in the passage;

the follower including a friction facility adapted to generate a frictional force against the front and rear walls to support cartridges during loading in the absence of biasing force from the first spring mechanism.

11. The magazine of claim 10 wherein the friction facility includes a metal spring.

12. The magazine of claim 10 wherein the friction facility includes an elongated body having a compressible length.

13. The magazine of claim 10 wherein the friction facility has a form of an ammunition cartridge.

14. A magazine for a firearm comprising:

a housing defining an ammunition passage having an outlet;

a first spring mechanism adapted to bias ammunition in the ammunition passage toward the outlet;

a follower element in the ammunition passage;

the follower element including an elongated body defining a body axis;

a second spring mechanism adapted to generate a biasing force against a passage surface portion in a direction parallel to the body axis, such that the follower creates friction to support cartridges during loading in the absence of a biasing force from the first spring mechanism.

15. The magazine of claim 14 wherein the elongated body has the form of an ammunition cartridge.

16. The magazine of claim 14 wherein the follower element includes an elongated element having a first end and an opposed second end, and wherein the second spring mechanism is interconnected between the first end and the second end to bias the first end away from the second end.

17. The magazine of claim 14 wherein the front and rear interior surfaces are parallel to each other.

18. The magazine of claim 14 wherein the follower element includes a first portion and a second portion telescopically movable with respect to each other and wherein the second spring mechanism biases the first portion and the second portion away from each other.

19. The magazine of claim 14 wherein the follower element is adapted to generate an expansive force within the passage.

20. A magazine for a firearm comprising:

a housing defining an ammunition passage having an outlet;

a first spring mechanism adapted to bias ammunition in the ammunition passage toward the outlet;

a follower element in the ammunition passage;

the follower element including a second spring mechanism adapted to generate a biasing force against a passage surface portion, such that the follower creates friction to support cartridges during loading in the absence of a biasing force from the first spring mechanism; and wherein the follower element includes a first portion and a second portion telescopically movable with respect to each other and wherein the second spring mechanism biases the first portion and the second portion away from each other.

* * * * *